US005612593A

United States Patent [19]

Olson

[11] Patent Number: 5,612,593

[45] Date of Patent: Mar. 18, 1997

[54] FLUORESCENT TUBE THERMAL MANAGEMENT SYSTEM UTILIZING THERMAL ELECTRIC COOLER UNITS

[75] Inventor: Scot L. Olson, Mt. Vernon, Iowa

[73] Assignee: Rockwell International, Seal Beach, Calif.

[21] Appl. No.: 521,200

[22] Filed: Aug. 30, 1995

[51] Int. Cl.[6] ..... H01J 7/24; H05B 31/24

[52] U.S. Cl. ..... 315/117; 313/13

[58] Field of Search ..... 315/112, 117, 315/50; 313/11, 12, 13

[56] References Cited

U.S. PATENT DOCUMENTS 3,309,565 3/1967 Clark et al. ..... 315/117

4,529,912 7/1985 Northrup et al. ..... 315/117

4,978,890 12/1990 Sekiguchi et al. ..... 315/117

*Primary Examiner*—Robert Pascal

*Assistant Examiner*—David H. Vu

*Attorney, Agent, or Firm*—Kyle Eppele; M. Lee Murrah; George A. Montanye

[57] ABSTRACT

A system for actively monitoring and controlling the effective ambient temperature in an application utilizing a fluorescent tube as the source of illumination. The system is the combination of a fluorescent tube, which may be thermally bonded to a reflector plate that is in physical contact with thermal electric cooler units and a heat sink. A temperature sensor in conjunction with drive circuitry and a power source, directs a magnitude and direction of current flow through the thermal electric cooler units thereby controlling the ambient operating temperature of the fluorescent tube.

20 Claims, 3 Drawing Sheets

FLUORESCENT TUBE THERMAL MANAGEMENT SYSTEM UTILIZING THERMAL ELECTRIC COOLER UNITS

FIELD OF THE INVENTION

The present invention relates generally to lighting systems, and more particularly to lighting systems utilizing fluorescent tubes as illumination sources and having performance requirements in which ambient temperature management of the fluorescent tube is important.

BACKGROUND OF THE INVENTION

Hot cathode discharge lamps, particularly the fluorescent lamp variety, are widely used in device displays and lighting systems. Upon the application of an applied voltage to the fluorescent tube, a filament heats and releases enough electrons into the tube for the lamp to arc from the voltage applied across opposing cathodes. The length of time in which a fluorescent tube requires in order to establish a sustained arc is dependent upon many variables, one of which is ambient temperature.

At the cold end of the spectrum, the lamp does not want to start, and when it does, the amount of light is restricted because large populations of mercury atoms condense in pools along the inside surface of the cold glass tube. When the tube becomes overheated its efficiency at producing light drops dramatically.

Various schemes have been implemented in the past to accommodate the vagaries of temperature fluctuations. Such schemes typically implore costly, bulky additional components, that are often unacceptable in space constrained applications, such as avionics, medical and computer equipment. Additionally, the use of mechanical devices to control environmental conditions often results in increased maintenance and system failure due to reliability problems with such systems.

Accordingly, an improved system for accommodating temperature fluctuation is needed in certain applications utilizing fluorescent tube light sources.

SUMMARY OF THE INVENTION

The present invention comprises a system for providing maximum light intensity from a fluorescent tube light source over an extended temperature operating range. The system monitors the ambient temperature of the operating environment of the fluorescent tube and with the use of temperature gradient control means maintains the temperature at a predetermined level. In one embodiment of the system a serpentine multi-bend fluorescent tube is used in combination with a planar reflector, a thermal electric cooler unit and a heat exchanger. The system further provides for a temperature sensor, power source and drive circuitry coupled to the thermal electric cooler (TEC) unit so that in response to sensed temperature changes exceeding predetermined threshold a current is provided to the TEC thereby cooling or heating the fluorescent tube dependent upon the direction of the current flow and the magnitude of the current.

Alternate embodiments of the system include the use of a plurality of fluorescent tubes, TEC units or multi-layered temperature gradients comprised of repetitive stacking of planar reflectors and TECs in sandwich fashion or stacked TECs. Varying the dimensions of the planar reflector would also effect the operating range of the underlying system. One may also utilize thermal bonding adhesives to secure the fluorescent tube to the reflector assembly, thereby increasing the thermal energy transfer between the fluorescent tube and the temperature gradient device.

It is an object of the present invention to provide a simplified system for maximizing light intensity from a fluorescent tube light source over a wide operating temperature range.

It is an additional object of the present system to provide a robust lighting system with superior reliability than prior art systems.

It is a feature of the present invention to utilize temperature gradient means localized to a given fluorescent tube light source.

It is yet another feature of the present invention to provide a lighting system that utilizes multiple layers of reflector plates and thermal electric cooling units as principal components of a thermal gradient.

It is an advantage of the present invention that a device utilizing fluorescent lighting exhibits increased clarity and longevity when operating over a wide temperature range.

These and other objects, features and advantages are disclosed and claimed in the specification, figures and claims of the present application.

DESCRIPTION OF THE PREFERRED EMBODIMENT

Figure 1:
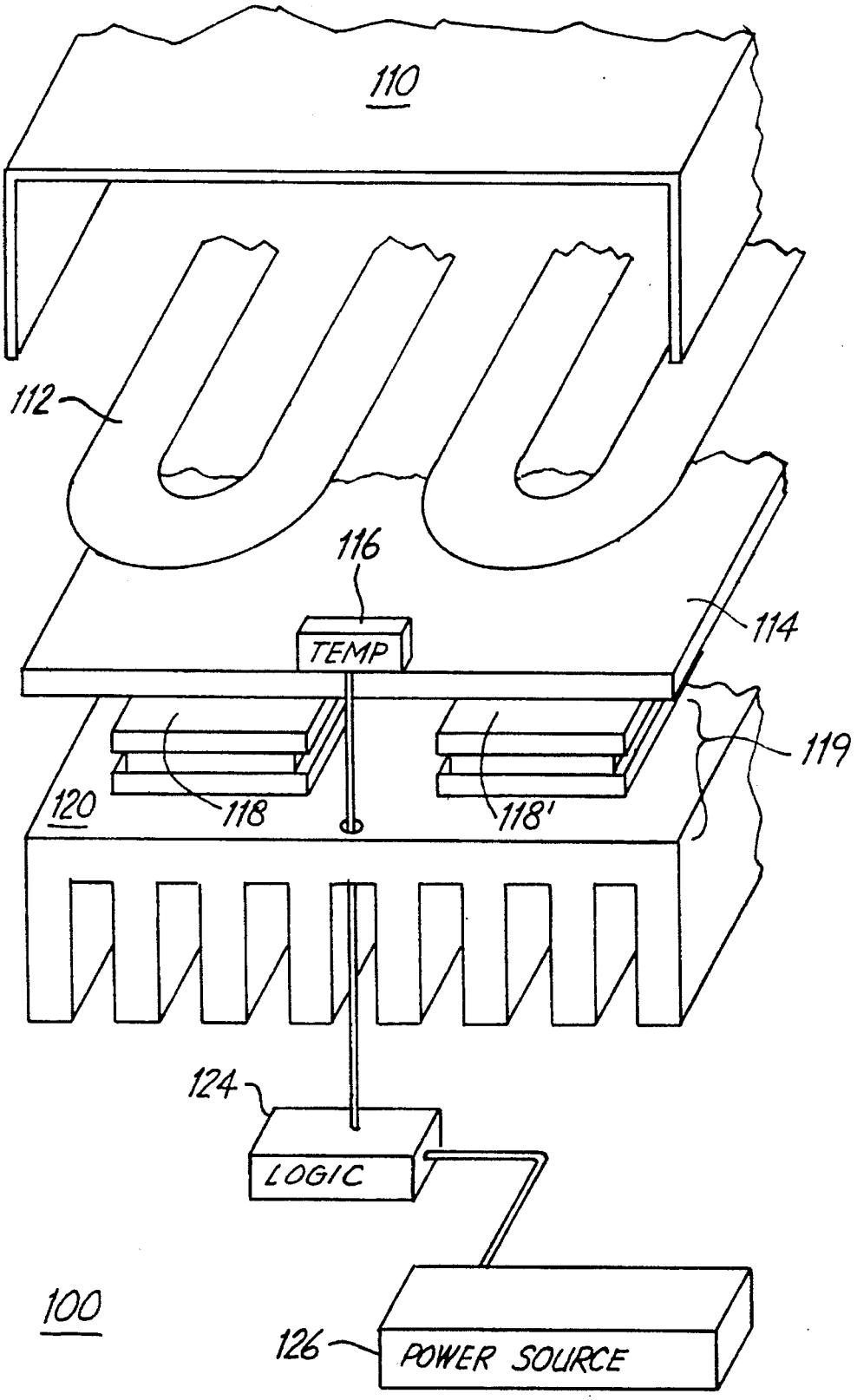
FIG. 1 illustrates an exploded perspective view of a fluorescent lighting system incorporating the teachings of the present invention.

Referring now to the drawings, wherein like items are referenced as such throughout, FIG. 1 illustrates an exploded perspective view of an display instrument 100 incorporating the teachings of the present invention. A non-light emitting screen 110, such as a liquid crystal display ("LCD"), provides various information for viewing by an observer. A fluorescent tube 112, shown here as a five bend serpentine configuration, provides illumination for the LCD. It should be noted that the fluorescent tube 112 could also be a multi-tube configuration. A reflector assembly 114 supports the fluorescent tube 112 and the LCD 110 while also being contoured and constructed of materials conducive to directing a desired light intensity uniformly or non-uniformly to LCD 110. A temperature sensor 116, is located in the same portion of the space enclosed by the reflector assembly 114 and the LCD 110, as the fluorescent tube 112. The temperature sensor is calibrated to be responsive to maintaining a desired operating temperature of the fluorescent tube 112, such as 50° C.

On the side of the reflector assembly not in contact with the fluorescent tube 112, a pair of thermal electric cooler units 118, 118' are placed in direct physical contact on their upper planar surface with the surface of the reflector assembly 114. The thermal electric cooler units are commercially available components from ITI Ferro, Tech. of Chelmsford, Mass. The TEC units serve to transfer heat from one of its planar surfaces to the other, in manner and magnitude consistent with an electrical current flow through it. The bottom element, or horizontal member of the reflector assembly (approximately 0.05 inches thick in the embodiment of FIG. 1) in conjunction with the TEC units comprise what will hereinafter be referred to as a thermal gradient 119. The operating efficiency of the thermal gradient 119 is understood to be directly related to design parameter selection such as material and thickness of the bottom member of the reflector assembly, as well as the size and capacity, number and location of the TEC units.

On the planar surface of the TEC units not in contact with the reflector assembly, a heat exchanger 120 is physically coupled. The temperature sensor 116 is electrically coupled to logic circuitry 124 which in turn is coupled to a power source 126. The power source 126 is serially coupled to each TEC unit 118, 118'. The electrical coupling of the temperature sensor, logic circuitry, power source, and TEC units forms an open-loop system that responds to detected temperature variation in the proximity of the fluorescent tube by either removing or injecting heat into the area via the above described system.

Figure 2:
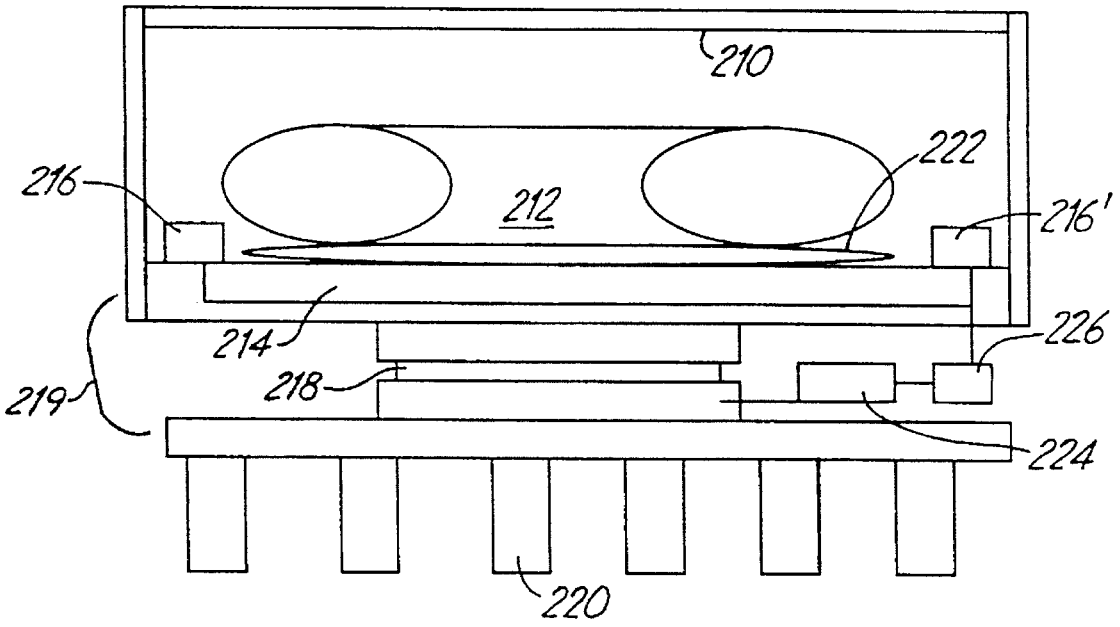
FIG. 2 illustrates across-sectional view of an device having an LCD and utilizing one embodiment of the present invention dependent upon a single thermal electric cooling unit.

FIG. 2 illustrates a cross section view of an alternate embodiment of the present invention. As shown a generally oval fluorescent tube 212 provides illumination for a display 210, supported and partially enclosed within a reflector assembly 214. A single TEC unit 218, disposed between and in physical contact with the reflector assembly and a heat exchanger 220 is also provided, thereby forming a thermal gradient 219. Two temperature sensors 216, 216' are electrically coupled to drive circuitry 224 which in turn is coupled to a power source 226, which in turn is coupled to the TEC unit. A thermal bonding agent 222, available as an epoxy type substance from The Grace Co. of Woburn, Mass. and available under the trade name of CHO-THERM or CHOMERICS. The use of the thermal bonding agent 222 in combination with the aforementioned components serves to provide superior heat transfer between the fluorescent tube and the heat exchanger.

Figure 3:
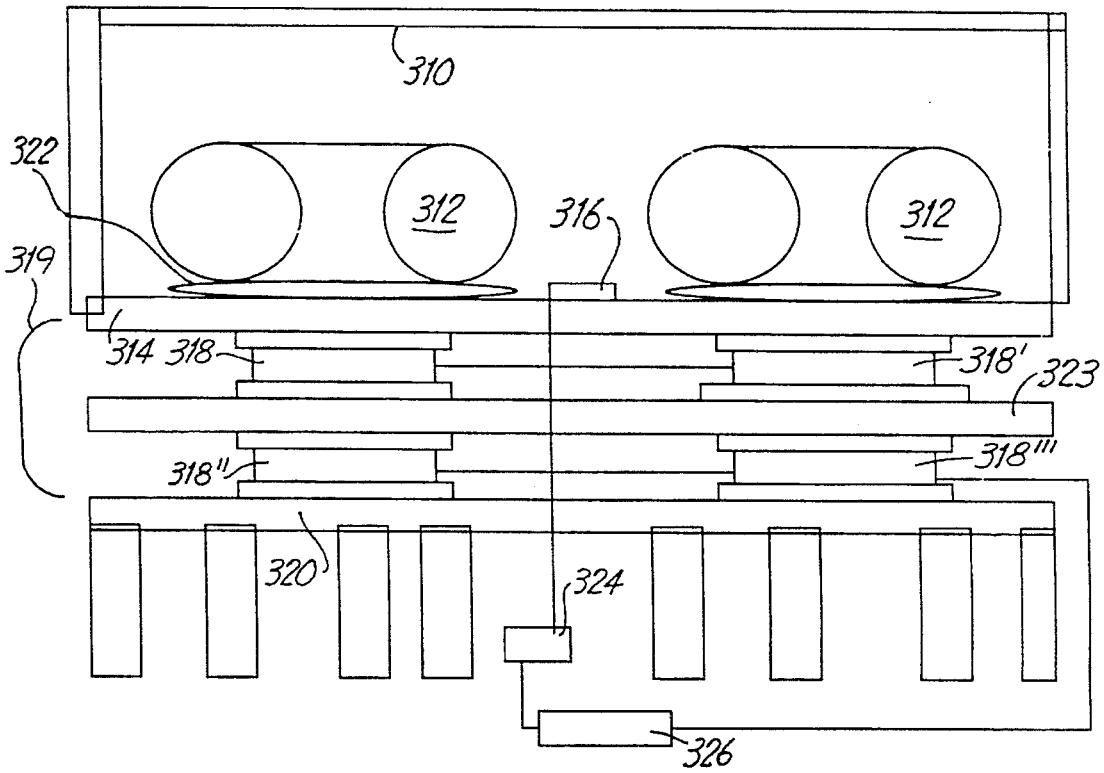
FIG. 3 illustrates is a cross-sectional view of display unit incorporating an alternate embodiment of the present invention utilizing a plurality of thermal transfer layers.

FIG. 3 illustrates a fluorescent lighting system incorporating the teachings of the present invention and utilizing a multi-layered thermal gradient 319. As in FIG. 2, a fluorescent tube 312 provides illumination for a display 310, supported and partially enclosed within a reflector assembly 314. A thermal bonding agent 322 is used to increase heat transfer between the tube 312 and the reflect assembly 314. As shown, an element 323, comprised of thermal conductive material sandwiches either side of a first layer of TEC units 318, 318' within the bottom planar element of the reflector assembly 314. A second layer of TEC units 318", 318'" are physically attached to the bottom planar surface of the element 323. A heat exchanger is subsequently physically attached to the lower planar surface of the TEC units 318", 318'". Each TEC is electrically coupled to a temperature sensor 316, via drive circuitry 324 and a signal generator 326. Use of the multi-layered thermal gradient 319 may be advantageous for certain perceived operating conditions. It has been noted that dependent upon materials utilized, heat transfer from the fluorescent tube through the thermal gradient and to the heat exchanger, or "cooling" the tube, is generally much less than the ability of the system to reverse the heat flow or "heat" the tube. Thus, by stacking components and forming a multi-layered thermal gradient the operating range may be greatly extended without requiring customized pads alternate production techniques, or inefficient oversized parts. It is understood that additional configurations of any combination of symmetrical or non-symmetrical arrangement of TEC units and thermal gradients 319 are also covered by this disclosure.

While particular embodiments of the present invention have been shown and described, it should be clear that changes and modifications may be made to such embodiments without departing from the true spirit of the invention. It is intended that the appended claims cover all such changes and modifications.

I claim:

1. A fluorescent tube lighting system, comprising:

a fluorescent tube as a source of illumination;

a first thermal gradient comprised of a reflector assembly, having a planar member in physical contact with the fluorescent tube;

a plurality of thermal electric cooler units, each having one side in physical contact with the surface of the planar member not in contact with the fluorescent tube;

a heat exchanger in physical contact with the plurality of thermal electric cooler units, on a side of the thermal reflector units not in contact with the reflector assembly;

a power source coupled to the thermal electric cooler units;

a temperature sensor proximately located to the fluorescent tube; and drive circuitry electrically coupled to the power source, temperature sensor and each thermal electric unit so that in response to sensed temperature an electric current from the power source is provided to the thermal electric units of varying magnitude and direction, thereby adjusting the effective temperature of the fluorescent tube.

2. The system of claim 1, further comprising a thermal bonding agent disposed between and in physical contact with the fluorescent tube and the planar member of the reflector assembly.

3. The system of claim 1, further comprising an additional thermal gradient layer.

4. The system of claim 3, wherein the TEC units are vertically aligned and identical in number and placement within each layer of the thermal gradient.

5. The system of claim 3, wherein the additional thermal gradient is comprised of a differing number of thermal electric cooling units than the first thermal gradient.

6. The system of claim 1, wherein the temperature sensor is comprised of a plurality of discrete elements.

7. The system of claim 1, wherein the plurality of thermal electric cooler units consists of two thermal electric cooler units.

8. The system of claim 1, wherein the planar member of the reflector assembly is approximately 0.05 inches in thickness.

9. A fluorescent tube lighting system comprising:

a plurality of fluorescent tubes as sources of illumination;

a first thermal gradient comprised of a reflector assembly, having a planar member in physical contact with the fluorescent tube;

a plurality of thermal electric cooler units, each having one side in physical contact with the surface of the planar member not in contact with the fluorescent tube;

a heat exchanger in physical contact with the plurality of thermal electric cooler units, on a side of the thermal reflector units not in contact with the reflector assembly;

a power source coupled to the thermal electric cooler units;

a temperature sensor proximately located to the fluorescent tube; and drive circuitry electrically coupled to the power source, temperature sensor and each thermal electric unit so that in response to sensed temperature an electric current from the power source is provided to the thermal electric units of varying magnitude and direction, thereby adjusting the effective temperature of the fluorescent tube.

10. The system of claim 9, further comprising a thermal bonding agent disposed between and in physical contact with the fluorescent tube and the planar member of the reflector assembly.

11. The system of claim 9, further comprising an additional thermal gradient layer.

12. The system of claim 11, wherein the thermal electric cooling units are vertically aligned and identical in number and placement within each layer of the thermal gradient.

13. The system of claim 9, wherein the temperature sensor is comprised of a plurality of discrete elements.

14. The system of claim 9, wherein the additional thermal gradient is comprised of a differing number of thermal electric cooling units than the first thermal gradient.

15. The system of claim 9, wherein the plurality of thermal electric cooler units consists of two thermal electric cooler units.

16. The system of claim 9, wherein the planar member of the reflector assembly is approximately 0.05 inches in thickness.

17. A method of controlling a fluorescent tube lighting system having a fluorescent tube, reflector assembly and thermal electric cooler units, comprising the following steps:

measuring the ambient air temperature of the fluorescent tube;

comparing the measured temperature value to a predetermined value;

determining the magnitude and direction of the measured value and predetermined value;

applying a current to the thermal electric cooling units in such manner as to minimize the difference between the measured temperature value and the predetermined value.

18. The method of claim 17, wherein the temperature measuring is accomplished via dedicated electrical circuitry and sensors and continuously updated.

19. The method of claim 17, further comprising thermally bonding the fluorescent tube to the planar reflector assembly with thermal epoxy adhesive material.

20. The method of claim 17 wherein the predetermined value is 50° C.

* * * * *